US006695798B2

(12) United States Patent
Chang

(10) Patent No.: US 6,695,798 B2
(45) Date of Patent: Feb. 24, 2004

(54) AIR CUSHION BED WITH MASSAGING DEVICE

(76) Inventor: Chi-An Chang, No. 1017, Jen Ai Village, Jen Te Country, Tainan County (TW)

( * ) Notice: Subject to any disclaimer, the term of this patent is extended or adjusted under 35 U.S.C. 154(b) by 162 days.

(21) Appl. No.: 09/987,378

(22) Filed: Nov. 14, 2001

(65) Prior Publication Data

US 2002/0128572 A1 Sep. 12, 2002

(30) Foreign Application Priority Data

Mar. 7, 2001 (TW) ..... 90203394 U

(51) Int. Cl.[7] ..... A61H 23/02; A61H 33/00

(52) U.S. Cl. ..... 601/49; 601/56; 601/70; 601/158

(58) Field of Search ..... 601/55, 56, 57, 601/58, 15, 16, 61, 64, 88, 105, 148, 149, 150, 152, 156, 49, 70, 158; 5/713, 714, 715, 914, 915, 600

(56) References Cited

U.S. PATENT DOCUMENTS 3,595,223 A * 7/1971 Castagna ..... 601/55
3,678,520 A * 7/1972 Evans ..... 5/713
4,048,684 A * 9/1977 Korner et al. ..... 601/150
4,175,297 A * 11/1979 Robbins et al. ..... 601/148
5,437,608 A * 8/1995 Cutler ..... 601/57
5,606,754 A * 3/1997 Hand et al. ..... 5/713
5,741,218 A * 4/1998 Fujii ..... 601/148
6,178,577 B1 * 1/2001 Chien-Chuan ..... 601/57

* cited by examiner

*Primary Examiner*—Nicholas D. Lucchesi
*Assistant Examiner*—Quang D Thanh
(74) *Attorney, Agent, or Firm*—Bacon & Thomas, PLLC

(57) ABSTRACT

An air cushion bed. The air cushion bed includes a massaging device. The massaging device includes an air cushion, vibrating motor, motor casing, massaging plate and adhesive strip. The air cushion includes air bladders that are linked together, and the vibrating motor is installed in the motor casing, whereon the massaging plate is installed. An adhesive strip is installed on the outer surface of the motor casing so that the motor casing can be fixed on the air bladders of the air cushion, allowing the air cushion bed to be a detachable device. The air cushion bed utilizes a microcomputer to activate the vibrating motor, which causes the motor casing to vibrate, which causes the massaging plate to vibrate, so that a patient resting on the massaging device can be massaged on the back portion through the vibration of the massaging plate, and the patient's blood circulation can be improved to minimize any bedsores for the patient.

14 Claims, 7 Drawing Sheets

AIR CUSHION BED WITH MASSAGING DEVICE

BACKGROUND OF THE INVENTION

1. Field of the Invention

The present invention relates to an air cushion bed with detachable massaging device, wherein the microcomputer is used to activate such massaging device, so as to provide the patient with massaging function toward the back and muscle portions of the patient.

2. Description of the Prior Art

For the prior art in sickbed design, aside from the consideration of the comfortableness of the sick, certain additional functions, like beds with air cushions, are added to accommodate the need of the disabled or patients in the persistent vegetative state. However, no prior art in sickbed design takes into account the massaging needs for patients unable to get off the sickbeds themselves.

Please refer to FIG. 1 of the prior art. The air cushion bed 1 mainly comprises a multiple of air bladders 11, an air conduit 12 and a control valve 13, with the air conduit 12 connecting the multiple of air bladders 11 and jointing the control valve 13. Therefore the user, by operating the control valve 13 to control the airflow, can adjust the air pressure of the air bladders 11, and enable the air cushion bed to be in a state of undulation for comfortable use by the user.

Nevertheless, the air cushion bed 1 of the prior art provides only the function of adjusting the air pressure of the air cushion for comfortable use, without considering the massaging need toward the back and muscle portions for disabled patients and patients in the persistent vegetative state, thus the patients with foregoing conditions may face health problems like lacking adequate exercises of the muscles, lacking adequate blood circulation and losing the function of capillaries.

SUMMARY OF THE INVENTION

The primary object of the present invention is to provide an air cushion bed with massaging device, including the air cushion bed comprised by a multiple of air bladders, and the massaging device. Such massaging device comprises the vibrating motor, the waterproof motor casing, the massaging plate, the controller and the adhesive strip; the vibrating motor is installed in the motor casing, whereon at least one massaging plate is installed, and at least one adhesive strip is installed on the outer surface of the motor casing, thus the massaging device can be fixed on the air bladder; with the controller activating the motor and motor casing to vibrate, the massaging plate is also brought to vibrate, therefore the patient resting on the massaging device can be massaged on the muscle portion having contact with the vibrating massaging plate, and the patient's blood circulation can be enlivened and capillaries working normally to avoid possible bedsores. It is necessary for the user to follow the instructions of doctors and rehabitation specialists regarding the implementation of the massaging device in the air cushion bed of the present invention, including the implementation with the accurate ways and areas of the body, and adjustment for the most adequate therapy process, thus the functions and effects can be enhanced, and the second-time injury caused by misuse of the massaging device can be avoided.

Material used in the massaging device of the present invention is all waterproof and insulated, therefore the patient shall never have to encounter the danger of electricity leaking during use. There is no safety concern regarding the use of the massaging device.

BRIEF DESCRIPTION OF THE DRAWINGS

These and other features, aspects and advantages of the present invention will become better understood with regard to the following description, appended claims and accompanying drawings where:

FIGS. 5A and 5B both show the first embodiment of the air cushion bed of the present invention; wherein FIG. 5A depicts the condition of the odd-number air bladders being inflated, and FIG. 5B depicts the condition of the even-number air bladders being inflated;

DETAILED DESCRIPTION OF THE PREFERRED EMBODIMENTS

Figure 1:
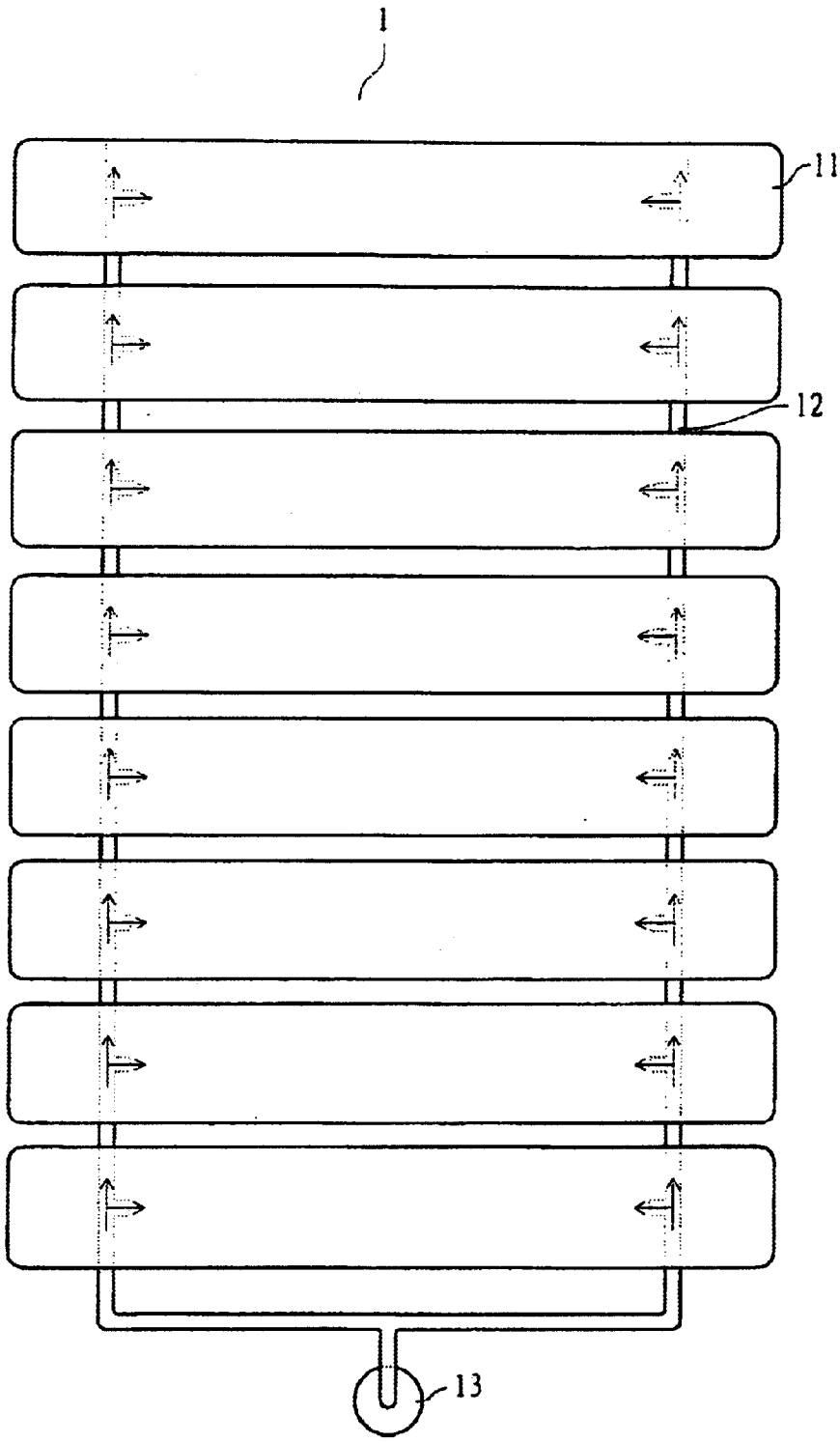
Fig. 1 PRIOR ART
FIG. 1 shows a top plan view of the air cushion bed of the prior art.
Figure 2:
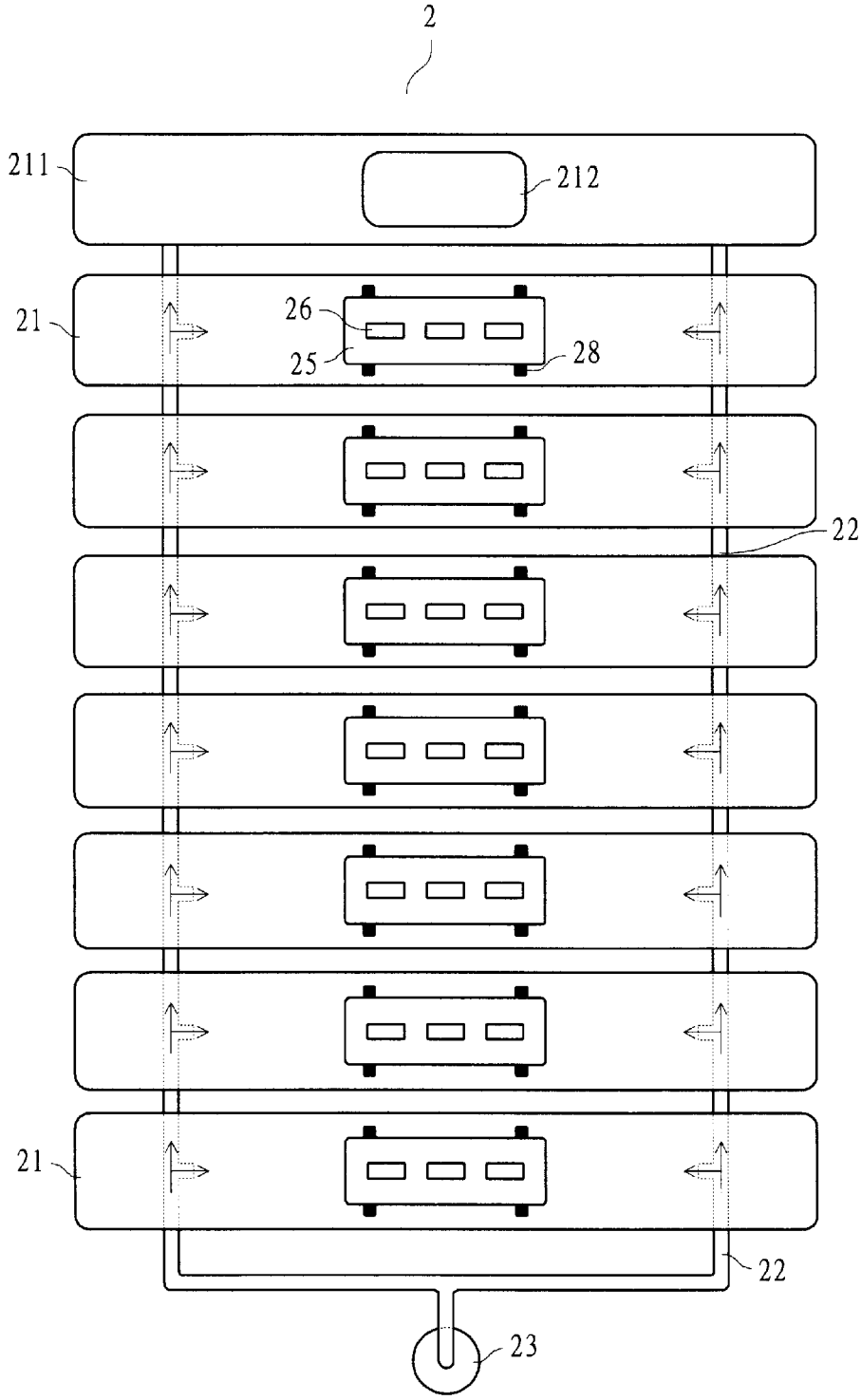
FIG. 2 shows a top plan view of the air cushion bed of the present invention.

As shown in FIG. 2, the air cushion bed with massaging device 2 of the present invention includes air bladder 21, air conduit 22, pump 23, vibrating motor, waterproof motor casing 25, massaging plate 26, controller and adhesive strip 28; the air bladder 21 is to be connected by the air conduit 22, and the area where the air bladder 21 supports the head of the patient is the air bladder 211 with air fully inflated for all time, and a detachable head pillow 212 is installed thereon. The air inlet of the air conduit 22 is jointed to the pump 23; the microcomputer controller is installed inside the motor casing 25 and is closely attached to the lower side surface of the motor casing 25, and also the vibrating motor is also installed inside the motor casing 25 and is connected to the microcomputer. On the top surface of the motor casing 25 the massaging plate 26 is fixed, and also on the surface of the motor casing 25 at least one adhesive strip 28 is installed, which fixes the motor casing 25 onto he air bladder 21 of the air cushion bed.

When the pump is activated, air is pumped out through the air conduit 22 into the air bladder 21, thus the air bladder 21 is inflated with air; and until the air pressure inside the air bladder 21 reaches a predetermined value, the microcomputer then activates the automatic switch to activate the vibrating motor, therefore the motor casing 25 is brought to vibrate, and further brings the massaging plate 26 to vibration. Thus the massaging plate 26 is to come in contact with muscles of the patient resting on the air cushion bed with massaging device 2, and with the vibrating massaging plate 26, the patient's blood circulation can be enlivened and capillaries working normally to avoid possible bedsores. Certainly it is necessary for the user to follow the instructions of doctors and rehabitation specialists regarding the implementation of the massaging device in the air cushion bed of the present invention, including the implementation with the accurate ways and areas of the body, and adjustment for the most adequate therapy process, thus the functions and effects can be enhanced, and the second-time injury caused by misuse of the massaging device can be avoided.

Figure 3:
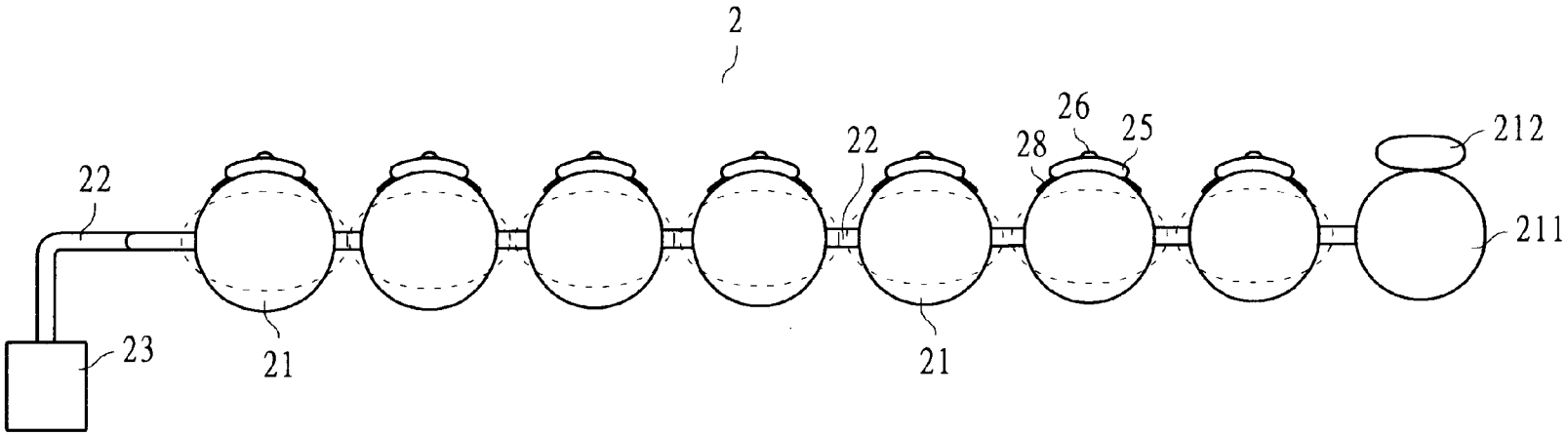
FIG. 3 shows a right side view of the air cushion bed of the present invention.

As shown in FIG. 3, the air cushion bed with massaging device 2 of the present invention utilizes the function of programming provided by the micro-computer controller, so when the pressure level of the air bladder 21 reaches a predetermined value, the vibrating motor is to be activated, and the running and stopping of the vibrating motor can be controlled; when the inflating volume of the air bladder 21 reaches 80% of the total volume (as shown by the dotted line in FIG. 3), the micro-computer controller then activates the electric switch to activate the vibrating motor and also brings the motor casing 25 to vibration, and further activates massaging 26 to vibrate. During this time the air bladder 21 continues to inflate and the massaging device continues working until the air volume in the air bladder is lower than 80%, the micro-computer then activates the electric switch to stop the running of the vibrating motor. Through this way, the air cushion bed with massaging device 2 of the present invention can be activated when the air inflating volume reaches 80% to 100% of the total volume, thus achieving the effect of massaging.

Figure 4:
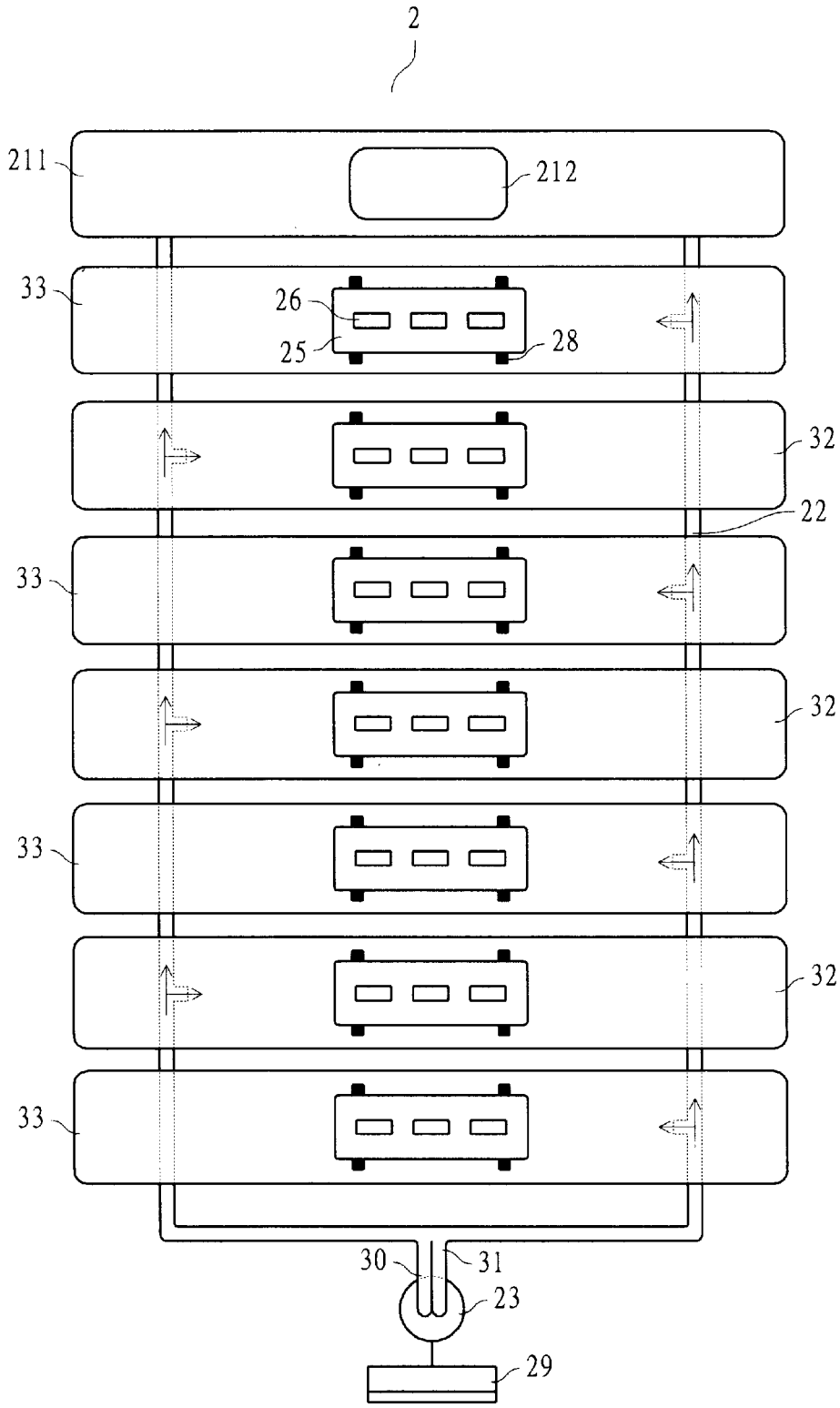
FIG. 4 shows an embodiment of the air cushion bed of the present invention.
Figure 5A:
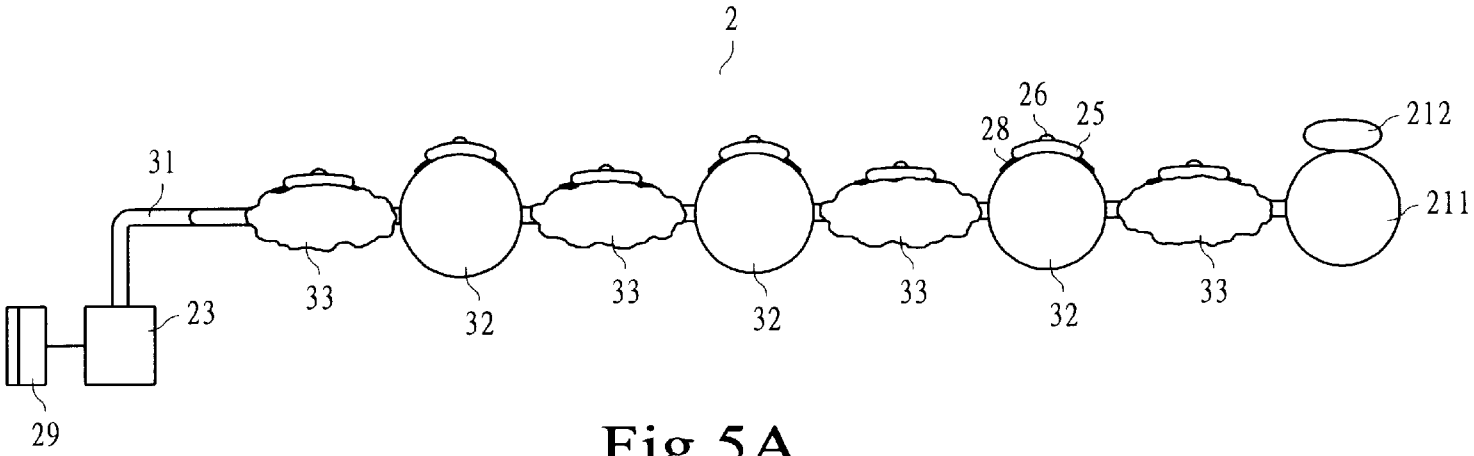
Figure 5B:
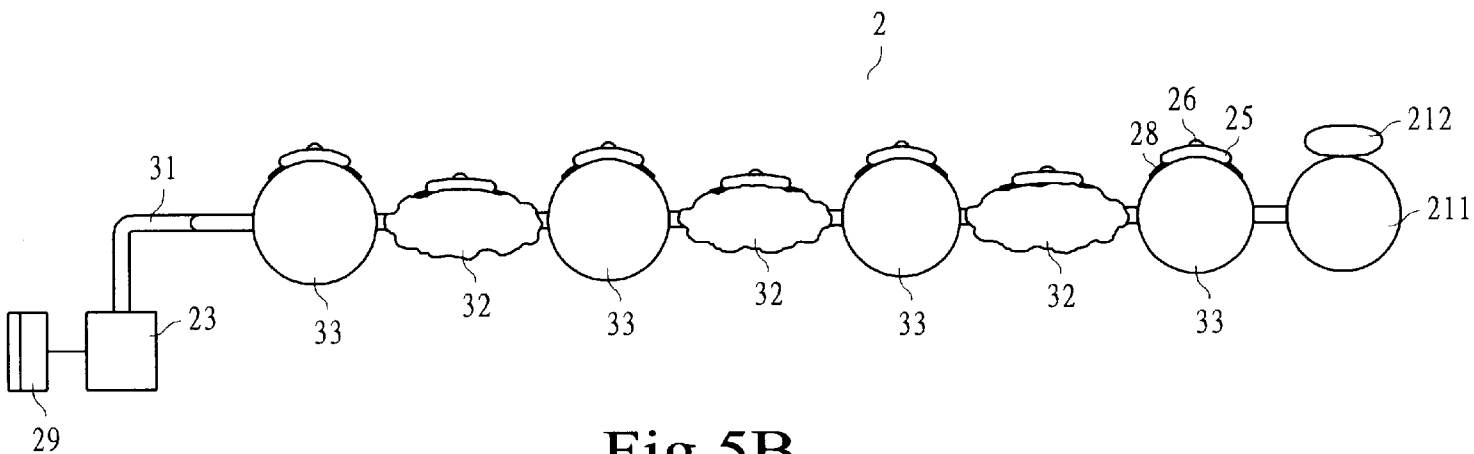

As shown in FIG. 4, the controlling valve 29 is an automatic micro-computing control system, which includes a pressure sensor, an automatic pressure controller and an electromagnetic tee valve, wherein the electromagnetic tee valve connects three tubes (one in and two outs), with one end linking the pump 23 to pump in air, and the other two ends linking the air conduits 30 and 31, while only either one of the two air conduits 30 and 31 receiving the air pumped in from the pump 23, with another one being shut. When the controlling valve 29 is activated, a signal is outputted to the pump 23 to pump air into the air conduit 30 through the electromagnetic tee valve, thus inflating the air bladder 32, as shown in FIG. 5-A. In addition, a pressure sensor, installed at the inlet tube near the electromagnetic tee valve, includes a signal wire that connects with the automatic pressure controller, wherein a pre-determined value is installed, thus when the pressure level of the air conduit 30 and the air bladder 32 reaches the predetermined pressure value, the automatic pressure controller will be activated to cause the electromagnetic tee valve to close the passage to the air conduit 30 and the air bladders 32, and to open the passage to the air conduit 31, thus inflating the air bladders 33, while the deflation of the air bladders 32 begins (refer to FIG. 5B). And then when the pressure level of the air conduit 31 and the air bladder 33 reaches the predetermined pressure value, the automatic pressure controller will again be activated to cause the electromagnetic tee valve to open the passage to the air conduit 30, thus inflating the air bladders 32 instead. Therefore the process repeats itself until the controlling valve 29 is turned off. With the process of alternately inflate and deflate the air bladders 32 and 33, the pressure points of the patient resting in bed and bodily areas being massaged are switched, thus enabling the patient to relax the muscles, enliven the blood circulation and prevent the damage or necrosis of the patient's back muscles. It is one of the embodiments of the present invention.

Figure 6:
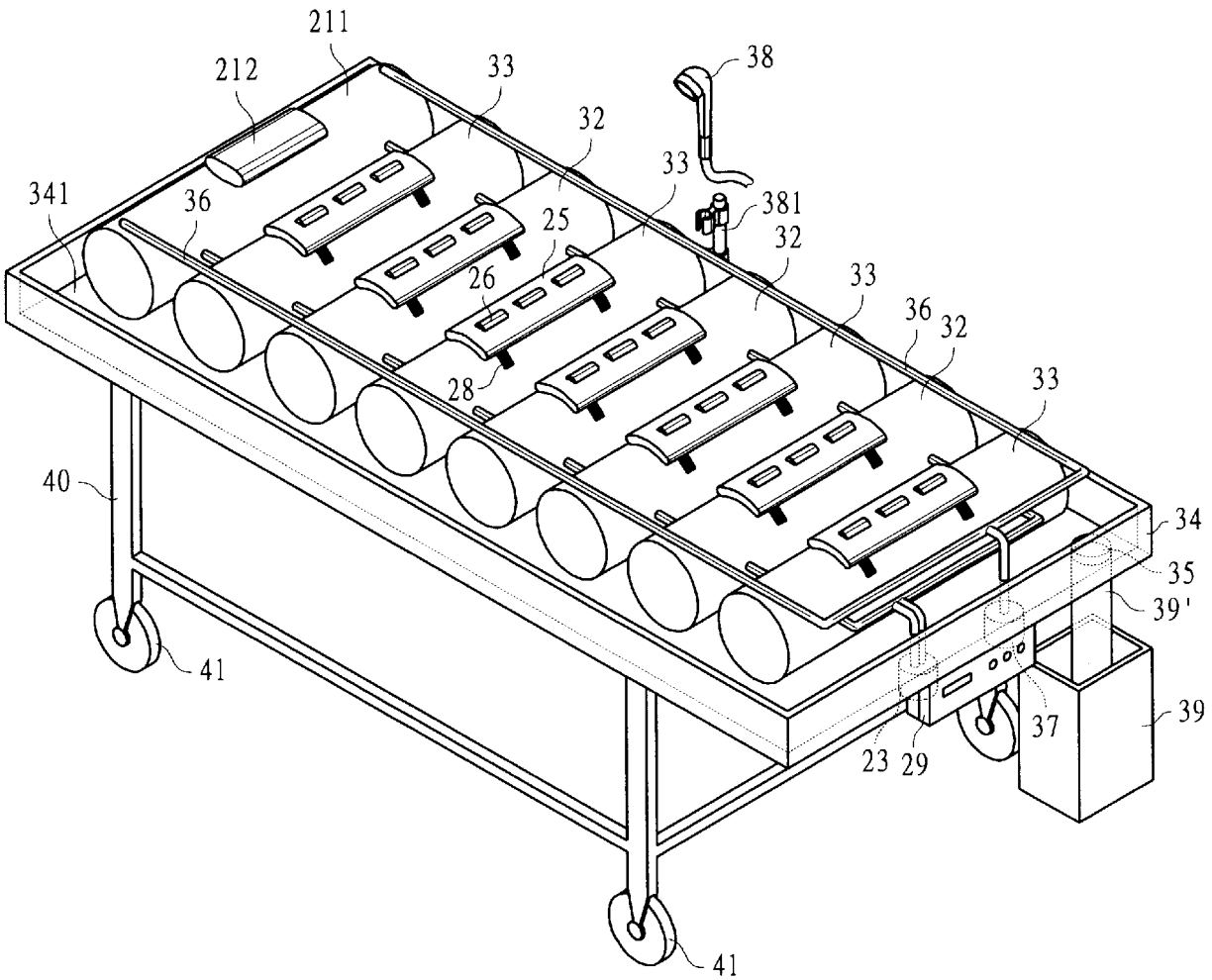
FIG. 6 shows the second embodiment of the air cushion bed of the present invention.

In another one of the embodiments of the present invention, as shown in FIG. 6, the air cushion bed with massaging device 2 can be installed inside a water tank 34 that is supported by a supporting frame 40 that contains at least four legs, with the end of each leg jointing a sliding wheel or turning wheel 41, enabling the air cushion bed with massaging device 2 to be moved with ease. In addition, the water tank 34 contains front, rear, left and right walls and a tilted base plate 341 with a water outlet, thus forming a water-holding space. The base plate 341 tilts from one end (e.g. the left end) to the other end (e.g. the right end), and from the upper end to the lower end, thus forming the tilting structure sloping from the upper left end to the lower right end. The water outlet 35, capable of filtering the wastewater, is installed at the lowest part of the base plate 341. The air cushion bed formed by air bladders 32 and 33 is placed on the top surface of the base plate 341 inside the water tank 34. The air conduit 36, jointed with the air pump 37, is installed at the top and both sides of the air bladders 32 and 33, and a bedding sheet is placed to cover the air conduit 36; also at the outlet of the air pump 37 an instant heating unit (not shown in drawings) can be added to heat up the air instantly, and the controlling valve 29 is electrically connected with the air pump 23 and 37 to form an electric loop, with the controlling valve 29 outputting signals to control the working of the air pump 23 and 37. At this time, the air conduit 36 may convey cool or heated air provided by the air pump, and spurt warm air to all directions via air holes of the air conduit 36, thus the bedding sheet can be kept warm. The tilting angle of the base plate 341 is so slight that the patient resting on the air cushion bed 2 shall not sense it; in addition, the air bladder 32 and 33 can be designed with linear variations, so that the horizontality of the air bladder 32 and 33 shall be kept after the completion of the inflation. The air cushion bed with massaging device 2 further comprises a shower nozzle 38 joining with the water hose, and a placing rack 381 whereon the shower nozzle 38 can be placed. The hot and cold water can be provided through the shower nozzle 38 for the user to wash hair and bathing. A water bucket 39 can be placed beneath the water outlet 35 to contain the wastewater, or a tube 39 can be connected to the water outlet 35 to channel the wastewater directly to the drainage ditch, while a filter is installed on top of the water outlet 35 to prevent body hair or other matters from blocking the flow of water, thus wastewater flows from the periphery of the air bladders 32 and 33 into the water tank 34, and then is channeled by the base plate 341 down to the water outlet 35. This embodiment of the present invention provides the functions of massaging and bathing the patient, the method of draining bodily waste and wastewater, and keeping the air cushion bed warm.

The air cushion bed with massaging device 2 may further contain a micro-switch in the controller, which, while activated by the inflated air bladders' coming into contact with the back portion of the patient, causes the vibrating motor to vibrate and further brings the massaging plate 26 to vibration as well, thus the massaging effect can be achieved. And then, when the air bladders deflate and no longer come into contact with the back portion of the patient, the micro-switch shall turn off the electricity, causing the vibrating motor to stop running, thus the massaging plate 26 also stop vibrating. The present invention, by using micro-switch to control the working of the vibrating motor, prevent unnecessary waste of electricity consumption, thus achieving the effect of saving the unnecessary consumption of electricity.

The other embodiment of the present invention comprises the massaging device that includes a casing 25 and a micro-switch; the casing 25 includes the motor and battery, also the massaging plate 26 is installed on the outer surface of the casing 25. When the air bladder does not come into contact with the back portion of the patient, the massaging device is not to vibrate; and yet when the air bladder inflates and comes into contact with the back portion of the patient, the bodily weight of the patient is to activate the micro-switch, which further activates the motor to vibrate and also brings the massaging plate 26 to vibrate as well, with the electricity provided by the transformer installed in the casing 25 to massage muscles of the patient. When the air bladder deflates and no longer comes into contact with the back portion of the patient, the micro-switch is to cause the massaging device to stop working, thus the massaging of the back portion of the patient by the massaging plate 26 is also stopped.

Figure 7:
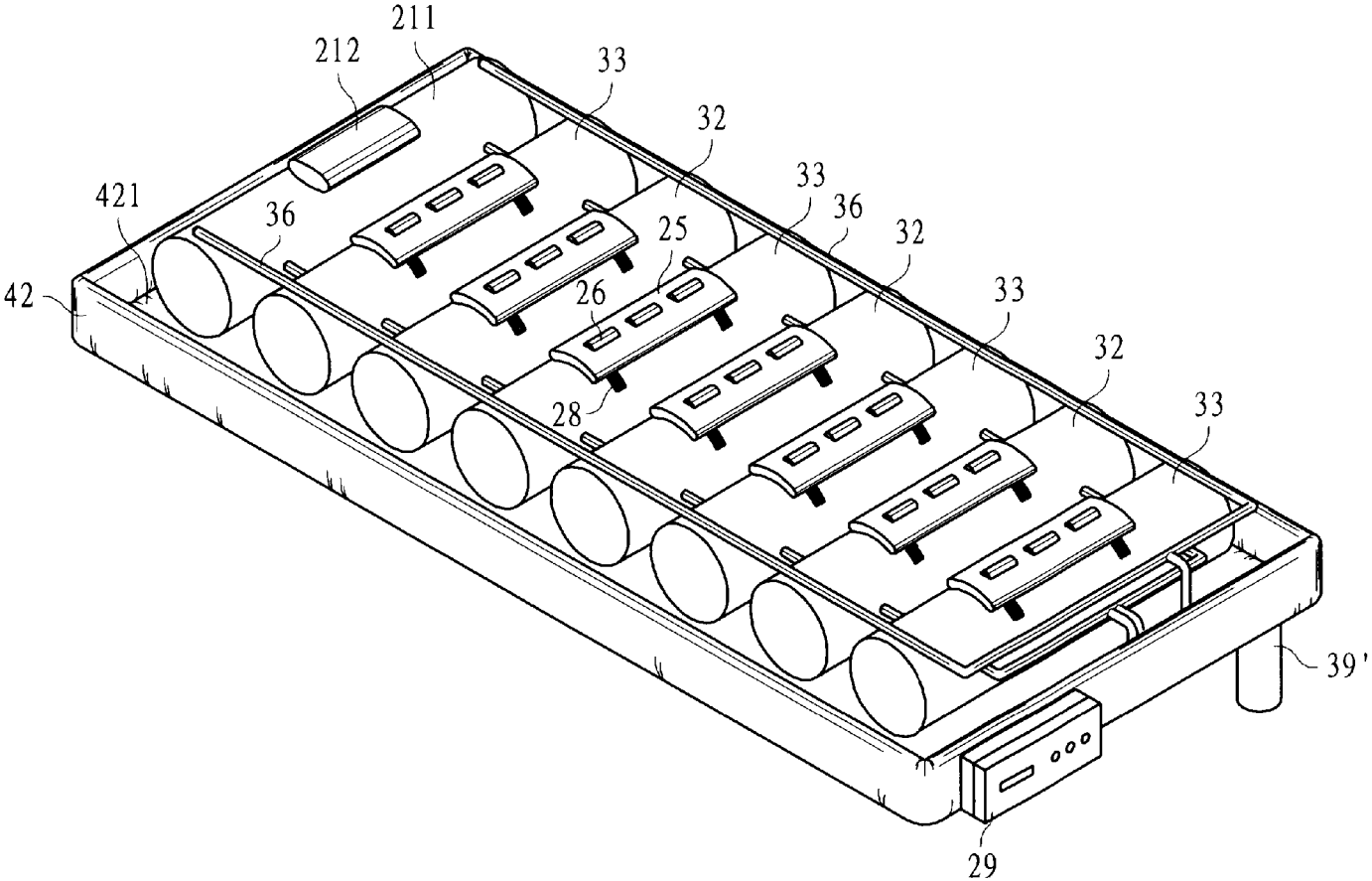
FIG. 7 shows the third embodiment of the air cushion bed of the present invention.

FIG. 7 shows another embodiment of the present invention, wherein the air cushion bed with the massaging device 2 is made of a waterproof material, thus forming a water-holding air container 42 to replace the water tank 34, with the air bladders 32 and 33 being placed in the concave area formed by the water-holding air container 42, wherewith an air conduit is connected, with another end connected to the first pump 23 to form an independent channel. When the controlling valve 29 is activated, a controlling signal is outputted to control the operation of the air pump 23 to inflate and deflate the water-holding air container 42 through the air conduit. And then, when the inflation of the water-holding air container 42 is completed, the bottom surface 421 of the concave in the water-holding air container 42 shall tilt from one end (e.g. the left end) to the other end (e.g. the right end), and from the upper end to the lower end, thus forming a tilted structure sloping from the upper left end to the lower right end, with a water outlet at the lowest part of the bottom surface 421. The tilting angle of the bottom surface 421 is so slight that the patient resting on the air cushion bed shall not sense it; besides, the air bladders 32 and 33 can be designed with linear variations in accordance with the degree of bias of the bottom surface 421, so that the horizontality of the air bladders 32 and 33 shall be kept after the completion of the inflation. Water is used to flush the bodily waste or clean the body of the patient resting on top of the air bladders 32 and 33, thereafter the wastewater is flushed through the peripheries of the air bladders 32 and 33 down to the water-holding air container 42, then is channeled by the bottom surface 421 and discharged through the water outlet. The embodiment of the present invention provides the user with the foldable function, for the air bladders 32 and 33 and the water-holding air container 42 can both be folded for safekeeping after complete deflation. Certainly the embodiment of the present invention, as the previous one, also provides cool or warm air, keeping the user, with the function of heat preserving and coolness-keeping, from dampening, germ-growing condition and skin affection. In addition, the air cushion bed can be put together with the supporting frame 40 and the turning wheels 41, so that the user can move the air cushion bed with ease. Moreover, the air cushion bed of the embodiment of the present invention can be installed with the shower nozzle 38, so that the user can flush with cool and warm water.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. An air cushion bed, comprising:

an air cushion comprising at least one air bladder;

at least one massaging device installed on a top surface of said air bladder, said massaging device can be activated to cause vibration;

a controller for activating said massaging device so that said massaging device is configured to massage muscles of a patient resting on said air cushion;

a water tank comprising a water-draining device and a water-holding space with a base plate and side walls; and said air cushion is placed upon said base plate.

2. The air cushion bed as in claim 1, wherein said water tank is integrally formed by said base plate and four side walls, including the front, the rear, the left and the right walls; said base plate is tilted to expedite the water-draining process.

3. The air cushion bed as in claim 2, wherein a water outlet is installed at the lower portion of said tilted base plate.

4. The air cushion bed as in claim 3, wherein a filter is installed on said water outlet to filter out matters that may block the water flow.

5. The air cushion bed as in claim 1, wherein said water tank comprises an inflatable air bladder that forms said water-holding space.

6. The air cushion bed as in claim 1, wherein said water tank is configured to be placed upon common sickbeds.

7. An air cushion bed, comprising:

an air cushion comprising at least one air bladder;

at least one massaging device installed on a top surface of said air bladder, said massaging device can be activated to cause vibration;

said massaging device is configured to massage muscles of a patient resting on said air cushion;

a water tank comprising a water-draining device and a water-holding space with a base plate and side walls; and said air cushion is placed upon said base plate.

8. The air cushion bed as in claim 7, wherein said water tank is integrally formed by said base plate and four side walls, including the front, the rear, the left and the right walls; said base plate is tilted to expedite the water-draining process.

9. The air cushion bed as in claim 8, wherein a water outlet is installed at the lower portion of said tilted base plate.

10. The air cushion bed as in claim 9, wherein a filter is installed on said water outlet to filter out matters that may block the water flow.

11. The air cushion bed as in claim 7, wherein said water tank comprises an inflatable air bladder that forms said water-holding space.

12. An air cushion bed, installed on a supporting frame having sliding wheels, comprising:

an air cushion, comprising at least one air bladder;

a water tank, having a tilted base plate; said air cushion is installed on said base plate, and a water outlet is installed at the lower portion of said tilted base plate; and at least one massaging device that, installed on the top surface of said air bladder, can be activated to cause vibration; and thus said massaging device can massage muscles of a patient resting on said air cushion.

13. The air cushion bed as in claim 12, wherein said air bladder is attached with a head pillow.

14. The air cushion bed as in claim 12, wherein said air bladder is made of waterproof material.

* * * * *